United States Patent [19]

Miller

[11] 4,091,137

[45] May 23, 1978

[54] POROUS NONWOVEN FILM-FIBRIL SHEET HAVING OPTICAL TRANSMISSION PROPERTIES

[75] Inventor: Philip Eugene Miller, Wilmington, Del.

[73] Assignee: E. I. Du Pont de Nemours and Company, Wilmington, Del.

[21] Appl. No.: 467,093

[22] Filed: May 3, 1974

Related U.S. Application Data

[63] Continuation-in-part of Ser. No. 236,384, Mar. 20, 1972, abandoned.

[51] Int. Cl.[2] ..... B32B 7/14

[52] U.S. Cl. ..... 428/198; 428/131; 428/156; 428/219; 428/280; 428/296; 428/340

[58] Field of Search ..... 161/116, 150, 164; 428/131, 198, 195, 156, 219, 280, 296, 340

[56] References Cited

U.S. PATENT DOCUMENTS

| | | | |
|---|---|---|---|
| 3,073,714 | 1/1963 | Tu et al. | 161/109 |
| 3,169,899 | 2/1965 | Steuber | 161/88 |
| 3,478,141 | 11/1969 | Dempsey et al. | 161/73 |
| 3,619,339 | 11/1971 | Garrett | 161/170 |

FOREIGN PATENT DOCUMENTS

| | | |
|---|---|---|
| 1,245,088 | 9/1971 | United Kingdom. |

*Primary Examiner*—William R. Dixon, Jr.

[57] ABSTRACT

A lightweight, abrasion resistant nonwoven film-fibril sheet of thermoplastic polymer embossed over substantially the entire area of at least one surface with a pattern comprising from 50 to 1000 small fused regions per square inch which in the aggregate represent from 3 to 25% of the total area of the surface of the sheet, said embossed regions having an average optical transmission of at least 50% and a method of making such sheets.

5 Claims, 3 Drawing Figures

POROUS NONWOVEN FILM-FIBRIL SHEET HAVING OPTICAL TRANSMISSION PROPERTIES

CROSS REFERENCE TO RELATED APPLICATION

This application is a continuation-in-part of my application Ser. No. 236,384, filed Mar. 20, 1972 now abandoned.

BACKGROUND OF THE INVENTION

This invention concerns an embossed lightweight nonwoven fibrous sheet product having a multiplicity of small transparent embossed areas substantially uniformly distributed across its surface and a method for preparing the same. The production of nonwoven sheets from continuous networks of film-fibril elements is described in U.S. Pat. No. 3,169,899 wherein a solution of polymer is flash-spun at a temperature above the boiling point of the solvent and at high pressure into a low pressure region, whereupon a three-dimensional network of film-fibrils forms at the spinneret. The continuous network is spread laterally by means of a baffle and is then collected in multidirectional, overlapping, and intersecting arrangement on a moving belt. The sheet may be consolidated by passing it through the nip of a pair of cold rolls.

Although such nonwoven sheet products have many uses directly as produced, a more abrasion resistant and delamination resistant product is desirable for certain end-uses. U.S. Pat. No. 3,478,141 describes a thermal point-embossing technique useful for bonding such sheets of film-fibril elements. The embossed regions of these sheets, referred to as point bonds, constitute numerous small areas where the film-fibril elements have been pressure-compacted and partially fused together, thereby decreasing the light scattering ability and increasing the light transmission for these bonded areas, which are accordingly also referred to as "translucent windows". On subsequently being subjected to a suitable mechanical softening treatment, the film-fibril elements in the regions between point bonds are "fluffed up" on a microscopic scale and thereby given more mobility, thus resulting in a soft drapable nonwoven sheet retaining good delamination and abrasion resistance by virtue of the residual point bonds. Such sheets are useful in disposable garments, as drapes and curtains, as protective packaging, etc.

In many such applications, it is desirable to provide a lighter weight sheet product, and this is in fact practical down to sheet basis weights of around 1.3 oz/yd$^2$ using the thermal point embossing technique. When such sheets are prepared in still lighter weights, they present variations in light transmission and reflection occasioned by local nonuniformity in sheet basis weight, which precludes their full acceptance in such applications even though their tensile properties are in fact fully adequate. This is due to the fact that low basis weight sheets offer less opportunity for averaging out nonuniformities since fewer layers of film-fibril network are present.

SUMMARY OF THE INVENTION

The present invention provides a method for improving uniformity in visual appearance of film-fibril nonwoven sheets of thermoplastic polymer by passing a nonwoven fibrous sheet product composed of continuous networks of film-fibril elements of thermoplastic material through the nip formed between two rolls, one of which has a heat-conductive surface with 50–1000 hard bosses per sq. inch which extend from the surface of the roll to a height at least 1.2X the thickness of the sheet to be treated. The boss have a total cross-sectional area measured at their tips equal to 3 to 25% of the area of the imaginary cylinder tangent to their tips. The opposite roll has a surface with a durometer hardness of at least 70 (Shore D scale). The rolls are operated at a nip pressure of at least 5 pounds per lineal inch (pli) per unit percent pattern area. Sufficient heat is provided through the heat-conducting roll and sufficient pressure is provided between the rolls to fuse the film-fibrils together on the surface areas of the sheet to form transparent windows directly beneath the bosses of the first roll without fusing the film-fibrils in the remaining area of the sheet. The novel product is a lightweight nonwoven fibrous sheet comprised of film-fibril elements of thermoplastic polymer embossed over substantially the entire area of at least one surface with a pattern comprising a multiplicity of small fused regions, said embossed regions having an average optical transmission of at least 50%.

BRIEF DESCRIPTION OF THE DRAWINGS

In FIG. 1 film-fibril sheet material 1 is provided from roll 2. The sheet material is generally in the range of 0.07 to 0.20 mms. in thickness. It is passed between the pair of rolls 3 and 4 to provide an embossed sheet 5 which is wound up on roll 6. The embossing roll 3 has a heat-conducting surface 7 which may be integral with roll 3 or may be a separate piece. Raised bosses 8 impress a pattern upon the film-fibril sheet as it passes between rolls 3 and 4, which are driven by means not shown. The surface of roll 4 has a durometer hardness of at least 70 (Shore D scale). Steam under regulated pressure is provided for a hollow chamber 10 in embossing roll 3. The temperature of the roll surface is controlled by regulation of steam pressure in the chamber 10. The embossing roll may alternatively be heated by circulating hot oil, by internal electrical resistance heaters or similar heating means commonly employed in the art.

In FIG. 2 the cross-section of an embossed film-fibril sheet 5 is shown as may be formed by operation of the apparatus of FIG. 1. The bond regions 13 are transparent "windows" in the film-fibril sheet which are formed by heat and pressure of the earlier referred to bosses 8 against backup roll 4. The film-fibrils in the first surface 15 of the window (the surface nearest the heated embossing roll) are fused together and the fibrils are inseparable in that region. This situation promotes high abrasion resistance on the first side of the sheet. On the other hand, fibrils on the second surface of the window 16 (the surface nearest the backup roll during treatment) are lightly bonded and do not contribute much in the way of abrasion resistance on the second side of the sheet. For this reason it is frequently convenient to reverse the sheet and provide a second embossing treatment if high abrasion resistance is needed on both sides of the sheet. Alternatively, one may provide two pairs of rolls, the second pair in opposite arrangement to the first pair. The intervening areas 14 between the areas contacted by the bosses remain substantially unfused by the embossing operation.

DESCRIPTION OF THE PREFERRED EMBODIMENTS

Figure 1:
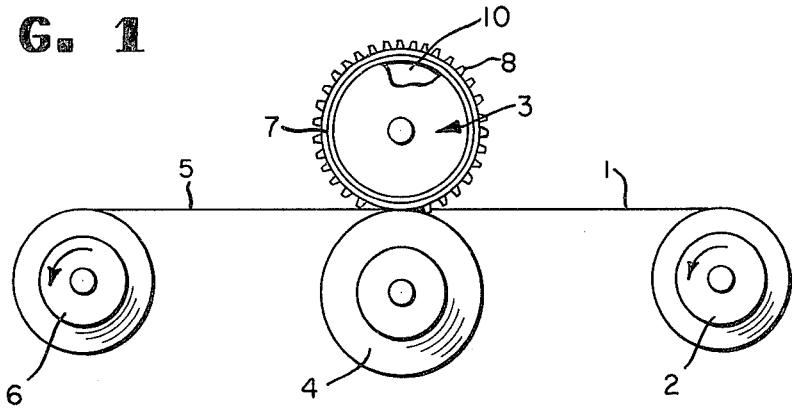
FIG. 1 is an end view of apparatus suitable for embossing the film-fibril sheet.
Figure 2:
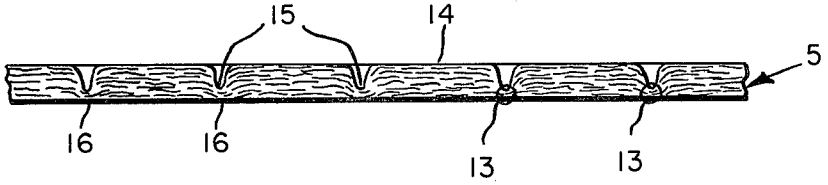
FIG. 2 is an enlarged cross-sectional view of a portion of an embossed film-fibril nonwoven sheet.

A most surprising feature of this invention is the substantial improvement in uniformity of visual appearance of the lightweight nonwoven sheets when they are embossed with a suitable pattern in a manner which provides embossed areas having transparencies of at least 50%. The asproduced lightweight nonwoven sheets, i.e., particularly those having an average basis weight of 1.3 oz./yd.$^2$ or less, inherently contain local nonuniformities which lead to defects in visual appearance of two general types referred to as "splotchiness" and "ropiness". Splotchiness refers to randomly occurring irregularly-shaped regions which are poorly defined, particularly at their peripheries, are of variable size in the approximate range ¼ inch to 2 inches and whose light transmission is somewhat greater than that of the surrounding matrix — presumably due to adventitious occurrences of lower-than-average basis weight regions. Ropiness refers to excess concentrations of approximately parallel, reasonably closely packed strands of fibrous material of irregular size on the order of 1–5 inches in length which occur at random throughout the sheet, and which are visible both by virtue of excess light reflection compared to the matrix background and by deficient light transmission compared to the background. (Although the same types of nonuniformities probably also occur in heavier basis weight sheets, they do not lead to defects in visual appearance, presumably because even the thinest regions of such products are still thick enough to be essentially as opaque as the thicker regions and therefore the whole sheet appears to the eye to be uniform.) Prior art embossing techniques, i.e., those producing "translucent" embossed regions, have been found generally to lead to further degradation in the appearance of such nonuniform low basis weight sheets products. However, in accordance with the present invention, it has surprisingly been discovered that when the embossing is carried out under even more severe conditions such that the optical contrast between the relatively opaque background matrix and the small embossed areas becomes large enough (i.e., when the transparency of the latter is increased to at least 50%) the embossed sheets of the invention appear to have greatly improved uniformity as compared to the precursor sheet. This improved appearance for the present products obtains not only when they are observed directly, i.e., either by reflected light or by transmitted light, but also even when "photo reproductions" of such sheets are examined.

Another surprising feature of the present invention is the discovery that the hydrostatic head (a measure of the ability of the sheet to restrain the passage of liquid water) measured for a nonwoven sheet embossed according to the present invention, i.e., having embossed areas with transparencies of at least 50%, is substantially greater than that for a sheet prepared from a comparable starting nonwoven sheet but embossed according to a prior art technique, i.e., having embossed areas with transparencies less than 50%. A still further surprising feature is that for two sets of samples A and B prepared from the same nonwoven sheet, both sets employing the identical embossing patterns but set A prepared with transparent embossed areas (% transmission greater than 50% employing the process of the present invention) and set B prepared with translucent embossed areas (% transmission less than 50% employing prior art technology), the tensile and tear strengths for samples in set A are appreciably higher than the corresponding tensile and tear strengths for samples in set B.

Nonwoven sheets suitable for use as starting materials in the present invention are composed of continuous networks of film-fibril elements, preferably of the cold-consolidated variety as defined and prepared in U.S. Pat. No. 3,169,899. Sheets having basis weights in the range from about 0.3 to 1.3 oz./yd.$^2$ are preferred, and those in the range 0.6 to 1.15 oz./yd.$^2$ are most preferred. The film-fibril elements must consist of a thermoplastic polymer, such as olefin polymer. The preferred thermoplastic polymer is linear polyethylene.

The embossed patterns useful for the present invention must be of a certain character. They must be composed of a multiplicity of small discrete regions in the range of 50–1000 regions per sq. inch, and the total area constituted by such embossed regions should represent 3 to 25% of the total area of the surface of the sheet. The individual embossed regions may conveniently all be of similar size and shape for a given embossed product. Within the foregoing population density and % coverage limitations, regions in the shape of dots, circles, triangles, straight or curved line segments, etc. are operable and a particularly preferred pattern consists of an array of regions in the form of crosses. The regions may be spaced in either a random or ordered array, but must cover essentially the entire surface of the sheet in a substantially uniform population density distribution. The most preferred arrays are those which, when employed in two-side embossing of the nonwoven sheets, do not lead to Moire effects, although a certain degree of overlapping of patterns on the two sides is permissible.

A most remarkable feature of the present invention is that even when embossing patterns meeting all the limitations enumerated above are employed, only marginal or no improvement in visual uniformity is achieved unless embossing conditions are adjusted to provide transparent embossed regions having average optical transmissions of at least 50%. Optical transmissions in excess of 65% for the embossed regions are preferred. The average % transmission is conveniently determined by the following procedure. An ordinary light microscope is selected with suitable magnifying power, and appropriate masking devices if needed, such that the field of view can be restricted to fall entirely within individual embossed regions. The quantity of light passing through the microscope is measured by substituting a photocell for the viewing eyepiece. Either the intensity of the illumination (incandescent bulb), the optics of the microscope, or the sensitivity of the meter measuring the output of the photocell is adjusted to provide a convenient reading from the photocell when no sample is present, and then without further changes the sample is inserted at the focal point such that the light path traverses only (a portion of) a single embossed region, and the new reading of light intensity is obtained with the photocell. The ratio of second reading to first reading is the % transmission. Values of % transmission at at least 10 different embossed regions, selected at random, are computed and averaged to yield the average optical transmission for the embossed sample.

In the examples hereinafter, two nonadjacent portions were cut from each embossed sheet and the % optical transmission measured for 10 randomly selected embossed regions within each portion. The results are reported as the "average % optical transmission" (arithmetical average of all 20 determinations) along with the statistically determined uncertainty at the 90% confidence limits.

It has been discovered that extraordinarily high embossing pressures are required in order to achieve sufficient degrees of compaction of the film-fibril elements of the nonwoven sheets to provide the required minimum 50% optical transmission in the embossed regions. For example, when employing metallic embossing rolls provided with an array of bosses meeting the pattern limitations given above, it has been found that nip pressures of at least 5 pli per unit % of pattern area are required, e.g., a minimum pressure of 60 pli is required for a pattern having 12% area coverage. Pressures from 8 to 16 pli per unit % pattern area are preferred, particularly for roll diameters of approximately 1 foot. Although they are operable to produce suitably transparent embossed regions, pressures substantially higher than this preferred range are generally to be avoided, since they lead not only to premature failure of the backup rolls, but also tend to produce perforation of the nonwoven sheets. In addition to these high nip pressures, the surface of the backup roll must have a hardness of at least 70 on the Shore D scale, and values of 80 to 90 are preferred. Substantially harder surfaces, though operable, require unduly tight tolerances on the perfection and uniformity of both the embossing and backup rolls to provide reasonable equipment durability, uniform pattern definition over the entire embossed sheet, and also to minimize perforation of the nonwoven sheet. The Shore equipment for measuring durometer hardness is manufactured by Shore Instrument Manufacturing Co., Inc. 20–25 Van Wyk Expressway, Jamaica, New York, N. Y. The durometer test is described in ASTM method D-1706-61 and in D-1484-59. Under these conditions the nip width between embossing roll and backup roll is approximately ⅛ inch to ¼ inch, thus providing extremely high embossing pressure at the faces of the bosses for pattern area coverages from 3% to 25%. In addition, since the embossing process of the present invention must be carried out at temperatures above the melting point of the polyolefin nonwoven sheet, the backup roll must have a substantial elevated temperature performance capability. (In some cases forced cooling of the backup roll surface may be desirable to increase its performance lifetime, providing the cooler backup roll surface does not degrade the character of the embossed pattern in the nonwoven sheet.) Finally, the backup roll surface must also have sufficient resiliency so that "coining" of the roll — even under high temperature, high pressure operation — does not occur. Suitable backup rolls have been provided by covering a steel roll core with a sheath of "Permavent" (trademark of Stowe-Woodward Co.) rubber, or a cast nylon polymer sheath, or a sheath composed of axially compressed Nomex® (trademark for Du Pont's high temperature resistant nylon paper) wafers.

The fused character of the film-fibrils in the embossed regions, as noted before, is reponsible for the improved surface stability of the nonwoven sheet. The embossed regions should be sufficiently fused so that the embossed surface exhibits an abrasion resistance rating of at least "good".

The abrasion resistance is determined by means of the Crockmeter tester of Atlas Electric Device Company, Chicago, Ill., CM-598. A sample is abraded against itself on the Crockmeter until the first surface fiber is disturbed (i.e., pops up). The abrasion resistance is reported as the number of cycles required to raise fibers from the surface of the sheet. The end point is determined visually. The abrasion resistance properties are reported as excellent, good, fair or poor. These terms correspond to greater than 13, 8 to 12, 4 to 7, and 3 or less cycles, respectively.

It has been discovered that fusion of the film-fibrils at the surface of the embossed regions must be accomplished simultaneously with the embossing operation. Thus, although cold embossing employing a suitable pattern as defined above plus very high nip pressures with adequately hard backup roll surface has been found to provide the marked improvement in visual uniformity exhibited by the products of this invention, such cold embossed sheets have limited utility due to their poor surface stability (low abrasion resistance). It is believed that the product of the present invention can only be prepared by employing a suitably patterned embossing roll which is heated to a temperature sufficiently high to cause fusion of the film-fibrils in the embossed regions at the embossing pressures and times employed. Embossing roll surface temperatures 30° to 40° C. above the melting point of the thermoplastic nonwoven sheet are preferred, with the higher temperatures being more suitable as the sheet velocity through the embossing nip is increased. Of course, one skilled in the art will take care not to employ temperatures so high as to cause melting and perforation of the sheet beneath the ends of the roll bosses. The height of the individual boss elements above the roll surface should be at least about 1.2X the thickness of the nonwoven sheet to be embossed in order that areas of the sheet between the boss elements remain substantially out of contact with the heated roll surface and therefore essentially unfused by the patterned embossing treatment.

Sheets from the process of the invention may be used without further treatment if the ultimate in softness is not needed. However, if a high degree of softness is desired, this may be obtained by subjecting the embossed sheet to flexing under water as in a domestic or commercial automatic washer. An alternative method comprises passing the sheet through a mechanical softener, such as by passing over a series of rolls having knobs or bosses which stroke the fabric to loosen it. It is advantageous to employ the minimum mechanical energy input which will achieve the required degree of softening of the product, so that the softening process will have the minimum effect on the embossed regions. The wash-softening process, for example, has been found to yield products with good softness which still retain almost the full measure of improved visual appearance provided by the embossing process of the present invention.

In the examples which follow, I, II, III, and VII illustrate preparation of the products of this invention employing various patterns, sheet basis weights and processing velocities. Example IV illustrates the criticality of using heated embossing rolls, and Example V illustrates the criticality of using backup rolls of at least 70D hardness plus the criticality of achieving at least 50% transparency in the embossed areas. Example VI provides several comparisons between prior art technology/products and those of the present invention.

EXAMPLE I

This Example illustrates preparation of embossed sheet according to the present invention where the embossed pattern is an array of small individual crosses. A nonwoven sheet composed of continuous networks of film-fibril elements of linear polyethylene is prepared by the process of U.S. Pat. No. 3,169,899 at a basis weight of 1.0 oz/yd$^2$. The as-prepared sheet has a relatively nonuniform appearance due to the presence of "splotchiness" and "ropiness" defects, as defined above.

This nonwoven sheet is embossed on first one surface and then the other employing a 34 inch Perkins calender. The heated embossing rolls are each 10 inches in diameter and have their entire surface covered with an array of bosses in the form of small individual crosses formed from two bars each 0.004 inch by 0.055 inch which intersect at right angles. The point of intersection occurs at the mid-point of the arm of the cross and at a point 0.012 inch from the top of the stem of the cross. The crosses are arranged in a regular pattern such that their stems fall on a grid of parallel lines spaced 0.050 inch apart. The crosses along any given line occur at 0.070 inch intervals, with the top end of each cross pointing in the same direction. The crosses in the adjacent lines also point in the same direction, which is therefore called the axis of the pattern, with these crosses displaced along the line by one-half a repeat unit, i.e., the arms of the crosses along a given line lie halfway between the arms of the crosses in the adjacent line. The embossing surface of the cross stands 0.010 inch above the face of the embossing roll. The array of crosses on the first embossing roll has its pattern axis parallel to the roll axis, while the pattern on the roll employed to emboss the opposite surface of the sheet has its axis perpendicular to the roll axis. These patterns each have about 280 bosses per sq. inch and provide an effective embossed area of about 12% of the sheet surface. The backup roll employed has a 10-inch diameter steel core covered with a ½-inch thick sheath of "Permavent" (trademark of Stowe-Woodward) rubber having a Durometer hardness of 82 on the Shore D scale.

The embossing rolls are each heated with steam at a regulated pressure of 65 psig and loaded to a nip pressure of 167 pli or about 14 pli per % pattern area, and the sheet is embossed at a linear velocity of 50 ypm. The embossed sheet exhibits a remarkable improvement in visual uniformity in that the splotchiness and ropiness are no longer apparent in either reflected or transmitted light. (On casual inspection, the nonwoven sheet simulates a woven fabric by virtue of the pattern of small embossed crosses.) The average optical transmission of the embossed crosses is determined to be 66.9 ± 2.5%, compared to an average transmission of only 4.4 ± 0.7% for the relatively opaque surrounding (unembossed) matrix. The abrasion resistance of the sample is measured at 12 cycles, for a rating of "good", thus indicating good fusion of the embossed regions.

EXAMPLE II

The procedure of Example I is repeated, except that a nonwoven sheet of only 0.8 oz./yd.$^2$ is employed, and that the embossing rolls are heated with steam at a pressure of 60 psig. Although the starting sheet exhibits at least as much splotchiness and ropiness as the 1.0 oz./yd.$^2$ sheet of Example I, the embossed and heat-fused product has an extraordinarily attractive uniform visual appearance. The embossed regions have an average optical transmission of 76.1 ± 3.8%.

EXAMPLE III

Another sample illustrating the present invention is prepared starting with a nonuniform sheet similar to that of Example I but having a basis weight of 1.15 oz/yd$^2$. A different embossing pattern called "boxcalf" is employed. This pattern consists of an array of slightly bowed line segments in a somewhat random but generally parallel arrangement at an average lateral spacing of about 1 mm. There are approximately 100 of these line segments per square inch (16 per square cm.) with a total embossing area of approximately 6%, and the pattern is such as to give the overall impression of a leather grain. As in Example I, the two surfaces of the sheet are embossed with the same pattern but with the axes of the patterns at 90° to each other (i.e., the line segments run approximately parallel to the sheet length on one surface and approximately parallel to the sheet width on the other surface).

The embossing rolls are each heated with steam at 65 psig. and 70 psig., respectively. The backup roll is a steel cylinder core wrapped with a sheath of Nomex® (trademark for Du Pont's high-temperature nylon paper) having a surface hardness of about 86 on the Shore D scale. Nip pressures of 120 pli or about 20 pli per % pattern area are used for embossing the two surfaces of the sheet at a linear speed of 50 ypm. The embossed sheet has a most attractive uniform appearance (no splotchiness or ropiness in evidence), and the embossed and fused regions have an average optical transparency of 56.3 ± 4.3%.

EXAMPLE IV

Example I is repeated, except that no heat is supplied to the embossing rolls. Although the embossed sheet produced has an attractive uniform appearance, the embossed regions are not fused. The product fails to meet the surface stability requirements of the present invention, since it survives only three cycles in the abrasion test for a rating of only "poor".

EXAMPLE V

The process of Example I is repeated, except that a backup roll comprising a 10-inch diameter steel core with a ¼-inch thick sheath of "Glossmate" (trademark of Stowe-Woodward) rubber having a Durometer hardness of only 60 on the Shore D scale is employed and nip pressures of 90 pli and 120 pli or about 7.5 pli and 10 pli per % pattern area are used. Although the embossed sheet exhibits improved appearance, some splotchiness and ropiness is still apparent. Due to the too soft backup roll surface, the embossed regions exhibit average optical transparency of only 44.4 ± 3.9%, and the product therefore fails marginally to meet the requirements of this invention.

When this experiment is repeated with the identical nip pressures and other conditions, excepting only that the harder backup roll of Example I is used, a fully satisfactory product meeting all the requirements of the present invention is obtained.

EXAMPLE VI

The three parts of this example provide various comparisons between prior art embossing technology/products and those of the present invention.

Part 1. A sheet is prepared using prior art embossing technology for comparison with the sheet of Example I of this invention. Another portion of the same initial 1.0 oz./yd.$^2$ nonwoven sheet employed in Example I is embossed on one surface with a "rib" pattern comprising parallel lines of point bonds each approximately 0.38 mm. by 0.38 mm. in area and separated by 0.091 cms. in the direction of the lines and by 0.158 cms. between lines, employing an embossing roll heated with steam at 54 psig. The sheet is then embossed on the other surface with a simulated "linen" pattern employing an embossing roll heated with steam at 50 psig. The backup roll is a 10-inch diameter steel core having a 1-inch thick sheath of Hypalon® (Du Pont registered trademark) having a hardness of 70 on the Shore B scale (which is therefore substantially softer than a surface rated 70 on the Shore D scale as required by the process of the present invention). Both embossing nips were loaded to 90 pli and the sheet was embossed at a linear velocity of 50 ypm. Although the embossed sheet has reasonable surface stability (abrasion resistance of 30+ cycles on the linen surface and five cycles on the rib surface), its visual uniformity remains quite poor. The average optical transparency of the embossed points in the rib pattern is only 20.6 ± 3.2% (referred to in the prior art as "translucent" windows) and hence well outside the requirements of the present invention.

Part 2. Samples S & T are prepared by embossing sheets similar to that of Example I, i.e., composed of continuous networks of film/fibril elements of linear polyethylene, except prepared at 1.3 oz./yd.$^2$ basis weight. Sample S is two-side embossed employing the patterns of Example 1 (cross) and process of this invention to produce a sheet of substantially improved uniformity of visual appearance. Sample T is two-side embossed with the "rib" and "linen" patterns described above in part 1, and employing a relatively soft backup roll to produce a sheet similar to the product of part 1. Both sheets S and T are next printed (Sinclair and Valentine green Flexo ink) and softened by mechanical working to provide decorative nonwoven sheet materials suitable for use in protective garments where liquid holdout properties are important, e.g., butcher aprons, rainwear, operating room gowns, etc. The hydrostatic head (ASTM D-583-63, 1970 edition, vol. 24, page 122, section 53A method II) is determined to be 44 inches (average of 20 areas tested) for sample S of the present invention compared to only 36 inches (average of 20 areas tested) for sample T.

Figure 3:
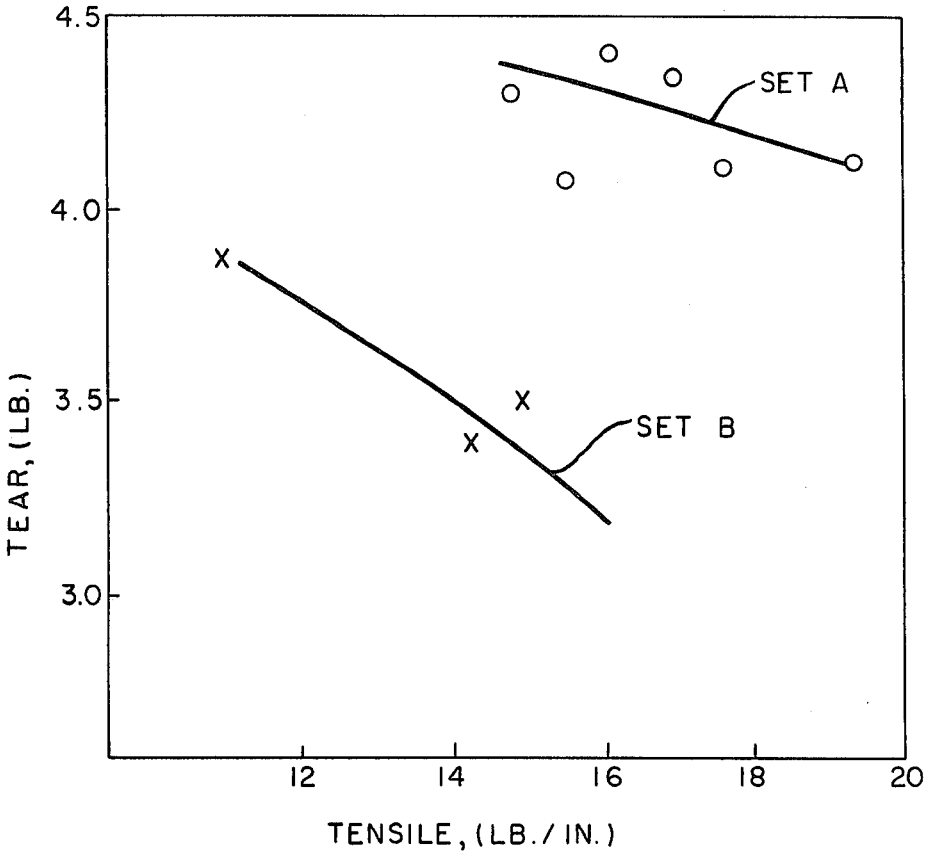
FIG. 3 shows the tensile/tear strength properties for sample sets A and B of Example VI, Part 3.

Part 3. Another nonwoven sheet of 1.7 oz./yd.$^2$ basis weight is two-side embossed with the "rib" and "linen" patterns of part 1 above to provide two sets of samples A and B. All samples in set A are prepared according to the process of the present invention employing a hard backup roll (77D), and various embossing roll temperatures in the range from about 145°–165° C. All samples in comparison set B are prepared employing a soft backup roll (80A), and various embossing roll temperatures in the same range. Even at this somewhat higher basis weight, all samples in set A exhibit more uniform visual appearance than the samples in set B, particularly when viewed in transmitted light. The tensile/tear strength data (all values shown are averages of machine and cross-machine direction values) for both sets of samples are shown in FIG. 3. For the samples within either set, the tensile strength may be incrementally increased at the expense of a slight loss in tear strength or vice versa, depending on the specific embossing roll temperature selected. However, as clearly shown in FIG. 3, all samples of the present invention in set A exhibit a substantially higher (superior) combination of tensile and tear strengths than those for samples in comparison set B.

EXAMPLE VII

This example illustrates preparation of a product of this invention at a higher rate of productivity. A 1.0 oz/yd$^2$ nonwoven linear polyethylene sheet similar to that of Example I is embossed with the same pattern employed in Example I, except that the embossing rolls are each 18 inches in diameter and 70 inches long. The backup rolls have 12½ inch diameter steel cores with ½ inch thick "Permavent" rubber sheaths, these particular samples having a surface hardness of approximately 80 on the Shore D scale. The embossing rolls are heated by circulating oil at 160° C. through their heat exchange chambers. The sheet is fed at a linear velocity of 175 ypm. and is preheated by making a 120° wrap around the surface of the embossing rolls before entering the embossing nip which is loaded to about 200 pli or about 17 pli per % of the pattern area. As before, the top and bottom surfaces of the sheets are successively embossed with the "array of crosses" patterns of Example I, with the pattern axes at right angles to each other. The resulting embossed sheet exhibits a desirable, uniform, visual appearance in marked contrast to the splotchy and ropy appearance of the lightweight starting sheet, and has good surface stability due to the heat-fused embossed regions.

What is claimed is:

1. A lightweight, abrasion resistant nonwoven film-fibril sheet of thermoplastic polymer embossed over substantially the entire area of at least one surface with a pattern comprising from 50 to 1000 small fused regions per square inch which in the aggregate represent from 3 to 25% of the total area of the surface of the sheet, said embossed regions having an average optical transmission of at least 50%.

2. The sheet of claim 1 having a basis weight of from 0.3 to 1.3 oz/yd$^2$.

3. The sheet of claim 1 having a basis weight of from 0.6 to 1.15 oz/yd$^2$.

4. The sheet of claim 1 wherein the polymer is polyethylene.

5. An abrasion-resistant nonwoven fibrous sheet having a basis weight of from about 0.3 to 1.3 oz./yd.$^2$ and being of improved uniformity of visual appearance, said sheet comprising continuous networks of film-fibril elements of olefin polymer, and being embossed over substantially the entire area of at least one surface thereof with a pattern comprising from 50 to 1,000 small fused regions per square inch which in the aggregate represent from 3 to 25% of the total area of the surface of the sheet, said embossed regions having an average optical transmission of at least 50%.

* * * * *